US006499233B1

(12) United States Patent
Chenevert

(10) Patent No.: US 6,499,233 B1
(45) Date of Patent: Dec. 31, 2002

(54) SPORT FOOTWEAR CONSTRUCTION

(75) Inventor: François Chenevert, Blainville (CA)

(73) Assignee: Bauer Nike Hockey Inc., Montreal (CA)

( * ) Notice: Subject to any disclaimer, the term of this patent is extended or adjusted under 35 U.S.C. 154(b) by 0 days.

(21) Appl. No.: 09/469,872

(22) Filed: Dec. 22, 1999

(30) Foreign Application Priority Data

Dec. 22, 1998 (CA) ..... 2256917

(51) Int. Cl.[7] ..... A43B 23/07

(52) U.S. Cl. ..... 36/55; 36/10; 36/115; 36/117.6

(58) Field of Search ..... 36/115, 88, 89, 36/93, 109, 92, 68, 117.6, 10, 55

(56) References Cited

U.S. PATENT DOCUMENTS

| | | | | |
|---|---|---|---|---|
| 1,243,993 A | | 10/1917 | Skoulikides | |
| 3,807,062 A | | 4/1974 | Spier | |
| 4,328,627 A | | 5/1982 | Sanders | |
| 4,385,456 A | | 5/1983 | Livernois et al. | |
| 4,509,276 A | | 4/1985 | Bourque | |
| 4,655,465 A | | 4/1987 | Schaeffer | |
| 4,777,741 A | | 10/1988 | James | |
| 4,835,885 A | | 6/1989 | Hoshizaki et al. | |
| 5,339,544 A | | 8/1994 | Caberlotto | |
| 5,342,070 A | | 8/1994 | Miller et al. | |
| 5,380,020 A | | 1/1995 | Arney et al. | |
| 5,692,319 A | | 12/1997 | Parker et al. | |
| 5,738,937 A | * | 4/1998 | Baychar | 428/316.6 |

FOREIGN PATENT DOCUMENTS

| | | |
|---|---|---|
| DE | 30 43 425 | 7/1982 |

* cited by examiner

*Primary Examiner*—Mickey Yu
*Assistant Examiner*—Troy Arnold
(74) *Attorney, Agent, or Firm*—RatnerPrestia

(57) ABSTRACT

A footwear is disclosed which comprises a molded shell for supporting and at least partially enclosing a wearer's foot. The shell has an inner side, an outer side, a sole portion covering the bottom area of the wearer's foot, lateral and medial quarters projecting upwardly from each side of the sole portion and a heel counter surrounding the back of the wearer's foot and linking the lateral and medial quarters together. An outer skin like covering is affixed to the outer side of the shell and a frontal toe portion substantially covers the toe area of the wearer. A tongue covers the upper frontal area of the footwear; and finally a ground engaging supporting element is mounted to the bottom of the shell. More specifically, an ice skate boot and an in-line roller skate are disclosed having shell and an outer skin.

40 Claims, 16 Drawing Sheets

SPORT FOOTWEAR CONSTRUCTION

FIELD OF THE INVENTION

The invention relates to a sport footwear construction and more particularly, to a skate boot construction for ice skates or in-line roller skates. The footwear construction is also adapted for hiking boots or sports shoes such as soccer, football, baseball and golf shoes or regular walking shoes.

BACKGROUND OF THE INVENTION

Traditionally, shoes, boots and skate boots are fabricated by stitching and gluing various layers of fabric, textile or leather material together over a last which is a three-dimensional shape of the inside walls of the desired form of boot or shoe. The rigidity and flexibility characteristics of the footwear are achieved by interposing various layers of materials having suitable mechanical properties in specific regions of the footwear. Often rigid plastic components are added to the construction to increase the strength and support of the footwear in specific areas. The footwear is usually completed with an outsole nailed, tacked or glued to the assembly of components and a cushioning insole positioned inside. For skates, a ground engaging supporting element such as an ice runner holder or an in-line roller chassis is mounted to the outsole to complete the product.

This type of construction is extensively used in the shoemaking industry. It generates a good product but has many disadvantages. For instance, the number of individual parts involved in high quality footwear can be staggering; a conventional ice skate for hockey may have some eighty parts to be assembled and shaped over the last. The considerable number of elements to be assembled entails an increased risk of errors during assembly, particularly in the alignment of the various elements. Furthermore, the assembly of various parts inevitably leads to undesirable variations of shape and volume of the footwear. For instance, seemingly identical size #9 footwear may have width variations which render many units uncomfortable to wear for some people. A consumer should technically try on different pairs of the same size to find a pair which best fits his or her feet. Also, in this type of construction, material is folded underneath the insole which necessarily implies an accumulation of material between the insole and the outsole thereby creating variations of the distance between the outsole and the pre-assembled upper.

Footwear so constructed will sometime exhibit poor form fitting of the foot because of the variations of the internal volume of the footwear resulting from variation of assembly inherent in this manufacturing process. Furthermore, because of those same variations of manufacturing, the rigid supporting components added to the footwear structure may not be properly positioned or oriented inside the footwear. A small variation of the position or orientation of the rigid components may render a footwear uncomfortable and provide inadequate support of the foot for the sporting activity it is designed for.

In an effort to reduce the number of components and to reduce variations of shape, volume, and support in the footwear construction, sports footwear have increasingly been made of a plastic molded shell and sometimes of a combination of rigid plastic with softer fabric components. U.S. Pat. No. 4,777,741 to Laurence discloses an article of footwear such as a shoe or skate, which comprises a molded outer shell and a semi-rigid molded tongue portion to close the footwear. This solution reduces the number of components but does not provide localized support of the foot as is required for optimal performance. The molded outer shell provides rigid support to the foot and ankle, however does not take into account the variation of support required for the specific sporting activity. U.S. Pat. No. 4,509,276 to Bourque discloses a skate boot made of a lower exterior molded rigid plastic portion and intermediate and upper portions made of pliable material to allow forward flexure and torsional flexibility in the ankle area. This construction again offers a rigid outer shell, which provides rigid support to the foot only and a softer more flexible support for the ankle.

U.S. Pat. No. 5,339,544 to Alberto discloses a footwear comprising a first component made of a single piece of molded synthetic material having a rear upper portion which extend from an insole, and a second component made of soft material having a front upper portion and a lining. The two components are connected together with the lining of the second component inserted inside the rear portion of the first component. This provides a two-piece rigid plastic outer shell construction having a limited amount of components. However, the foot support provided is randomly applied and arbitrarily separated in the middle of the foot.

Large plastic inserts have been designed to improve the general as well as the localized foot support. U.S. Pat. No. 3,807,062 to Spier discloses a boot having an inner molded shell formed of a rigid material for providing rigidity at selected locations such as the sole and toe area of the foot; and the heel and ankle portion of the foot; and an outer shell which is molded about the inner shell. The outer shell is made of a dissimilar plastic material having generally flexible and abrasion-resistant characteristics to provide flexibility at selected locations and also to provide an exterior surface capable of resisting surface wear and abrasion. The boot is thus reinforced at selected area while other areas are more flexible. Inserting a molded inner shell into a molded outer shell thus reduces the number of components. The boot is reinforced but does not provide adequate support of the foot. The boot is also left with an appearance which may not be appealing to consumer.

These designs effectively reduce the number of components utilized in the construction of footwear or skate. They also provide localized reinforcement to the footwear for increased performance. However, variations of the end shape and of the inner volume of the footwear remain. The foot support provided is often less than adequate for optimal performance. Finally, the appearance of some of these designs is not appealing.

Thus there is a need in the industry for a footwear construction having controlled end shape and volume of the footwear, which utilizes fewer components, provides optimal foot support for increased performance and has an exterior look which may be made more appealing to the consumer.

OBJECTS AND STATEMENT OF THE INVENTION

It is thus an object of the invention to provide a sport footwear construction made of fewer components than the traditional sport footwear.

It is another object of the invention to provide a sport footwear construction having improved overall foot support.

It is another object of the invention to provide a sport footwear construction that controls the end shape and inner volume of the footwear.

It is a further object of the invention to provide a sport footwear having an appealing look.

It is another object of the invention to provide a sport footwear construction that is cost effective to manufacture.

It is a further object of the invention to provide a sport footwear construction, which enable automation of the manufacturing process.

As embodied and broadly described herein, the invention provides a footwear comprising a shell for supporting and at least partially enclosing a wearer's foot. The shell has an inner side, an outer side, a sole portion covering the bottom area of the wearer's foot, lateral and medial quarters projecting upwardly from each side of the sole portion and a heel counter surrounding the back of the wearer's foot and linking the lateral and medial quarters together. The footwear further comprises an outer skin like covering affixed to the outer side of the shell; a frontal toe portion substantially covering the toe area of the wearer; a tongue covering the upper frontal area of the footwear; and a ground engaging supporting element mounted to the bottom of the shell.

Advantageously the footwear further comprising a footbed cushioning the sole portion and a lower inner portion of each side of the shell. The shell may further comprises an ankle counter located above said heel counter which surrounds the sides and back of the wearer's ankle and is shaped to overlie the wearer's malleoli. Preferably, the footwear further comprises a lining extending along an inside surface of said ankle counter. As a variant, the shell further comprises a tendon guard rising above the ankle counter and the lateral and medial quarters. The shell is shaped to generally conform to the anatomical contour of a human foot and ankle. The shell may further comprises a stiffening member defining the sole, the ankle counter and a portion of the heel counter which links the ankle counter and the sole together to form a continuous stiffening member.

As embodied and broadly described herein, the invention provides an ice skate comprising a shell for supporting and at least partially enclosing a wearers foot. The shell has an inner side, an outer side, a sole portion covering the bottom area of the wearer's foot, lateral and medial quarters projecting upwardly from each side of the sole portion, a heel counter and an ankle counter surrounding the back of the wearer's foot and linking the lateral and medial quarters together and a tendon guard located above the ankle counter. The ice skate further comprises an outer skin like covering affixed to the outer side of the shell, a frontal toe portion substantially covering the toe area of the wearer, a tongue covering the upper frontal area of the skate; and an ice runner holder and ice runner assembly mounted to the bottom of the shell.

Other objects and features of the invention will become apparent by reference to the following description and the drawings.

BRIEF DESCRIPTION OF THE DRAWINGS

A detailed description of the preferred embodiments of the present invention is provided herein below, by way of example only, with reference to the accompanying drawings, in which.

Figure 1:
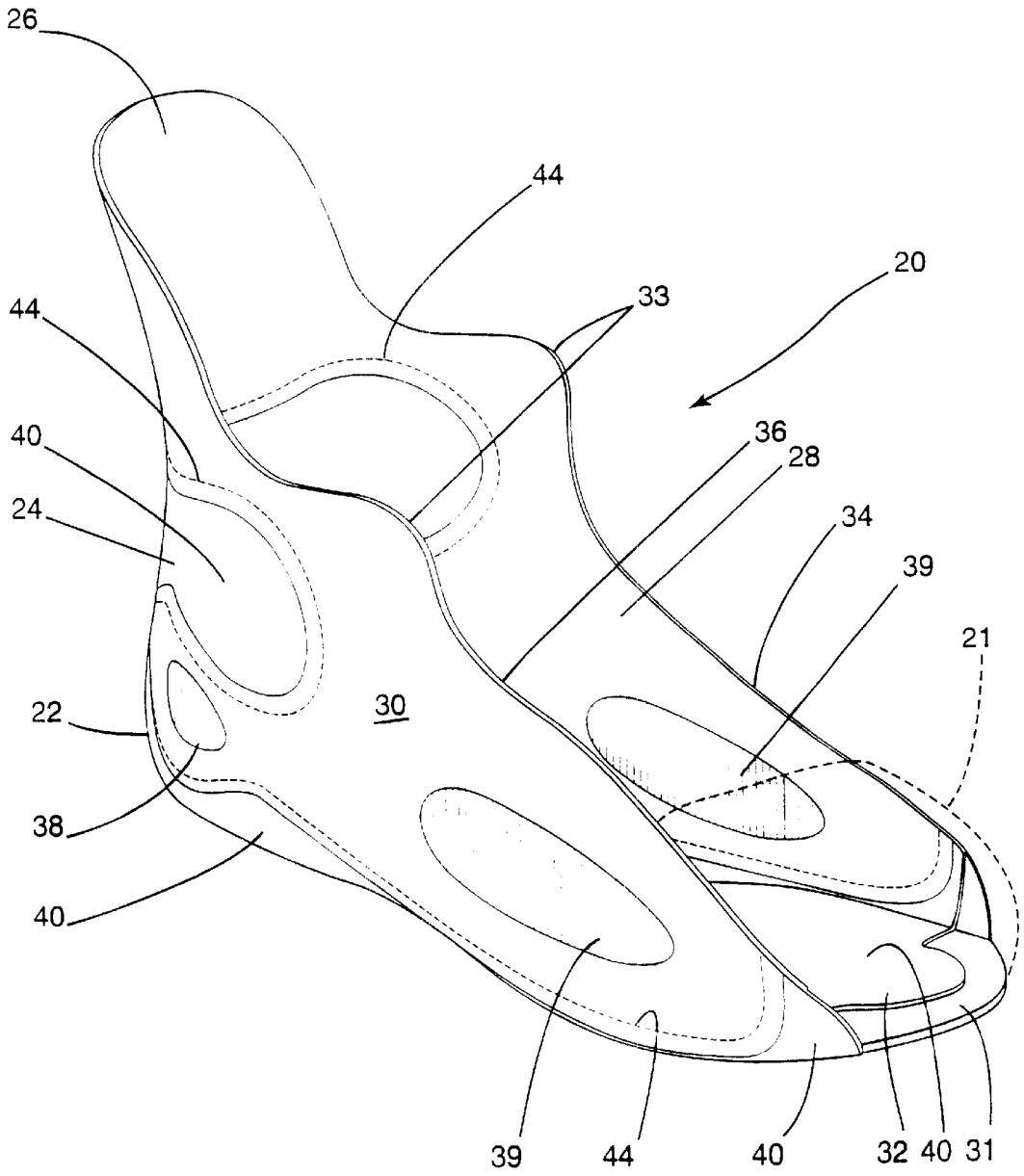
FIG. 1 is a perspective view of a first embodiment of a molded shell in a sport footwear according to the invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE PREFERRED EMBODIMENTS

Figure 4:
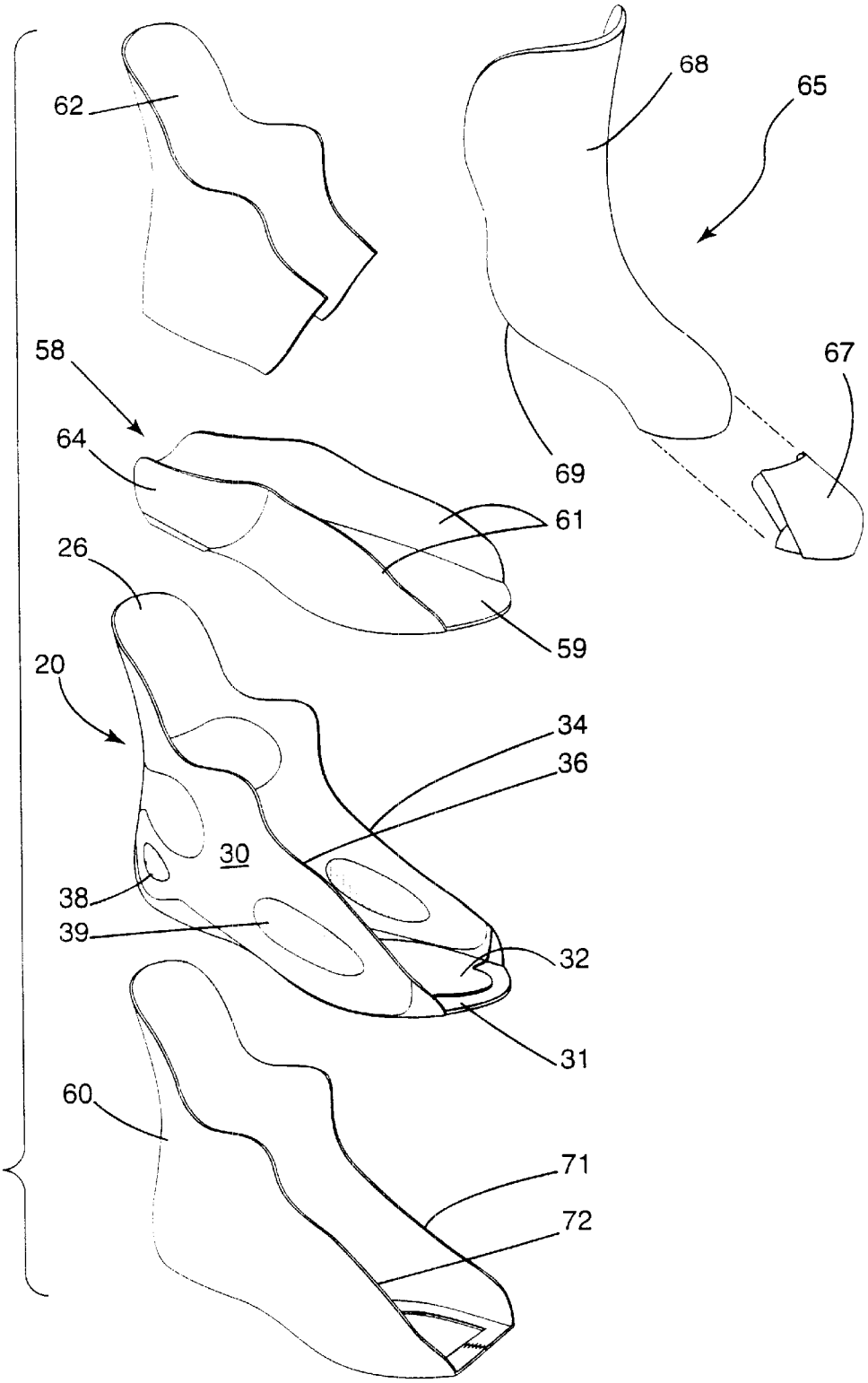
FIG. 4 is an exploded view of a first embodiment of a sport footwear construction according to the invention.

FIG. 1 illustrates a molded shell 20 having the general outer shape of a boot, which may be useful for making skates. Shell 20 is a monocoque preferably made and manufactured by injection molding of suitable thermoplastic material. It comprises a heel counter 22, an ankle counter 24, which surrounds the foot's malleolis, a tendon guard 26, and a medial quarter 28 and a lateral quarter 30. Each quarter 28, 30 extends longitudinally from heel and ankle counter 22 and 24, to the front of shell 20. A sole 32 extends the entire length of shell 20 and joins together quarters 28 and 30. Quarters 28 and 30 have edges 34 and 36,which together define the opening of the skate boot for insertion and removal of the foot. Each edge 34 and 36 has a upper leading segment 33 curving outwardly away from each other so as not to create a pressure zone in the frontal area of the wearer's ankle. Sole 32 further comprises a receptacle groove 31 adapted to receive a toe box. In the illustrated embodiment of FIG. 1, the frontal portion of shell 20 in the toe area is open. It allows the installation of a toe-box/tongue assembly 65 as shown in FIG. 4. As a variation, shell 20 could easily be closed at the toe area in such a manner that a toe box 21 shown in stippled lines would be integral with shell 20.

Shell 20 is the central structural component of a footwear according to this technique. It is molded to generally conform to the shape of the foot and ankle. The shape given to shell 20 dictates the general shape of the footwear. Shell 20 is designed with variable wall thickness to provide flexible areas and more or less rigid areas. Sole 32 is a portion where rigidity is required. Sole 32 may have a thickness of 4 to 5 mm to provide the necessary rigid platform for a skate. Quarters 28 and 30 have a thickness ranging from 1.5 mm in hatched portions 38 and 39, to about 3 mm for the remaining portions of quarters 28 and 30. The thinned walled portions 38 and 39 correspond to the bone pressure zones at the front and back of the foot and are shaped to substantially enclose these bony areas. Portions 38 and 39 provide more flexibility in these areas so that shell 20 will more easily conform to the bone structure of the foot in these particularly sensitive areas. Portions 39 are elongated and cover a substantial portion of the font of each quarter 28 and 30 while portions 38 are more constrained to the lower heel area. No ridges are noticeable between thinned portions 38, 39 and the remaining portions of quarters 28 and 30. Tendon guard 26 is also about 3 mm thick. By strategically varying the wall thickness of various areas of shell 20, it is possible to alter and control the behavior and physical properties of shell 20 for the specific requirement of the footwear being made.

As shown in FIG. 1, shell 20 is preferably, although not necessarily, made with two distinct thermoplastic materials. A first, more rigid thermoplastic, makes up sole 32 and ankle counter 24 to form a stiffening member 40 while the rest of shell 20 which includes tendon guard 26, and both lateral and medial quarters 28 and 30, is made of a second softer thermoplastic. Ankle counter 24 is a curvilinear segment surrounding the malleolis and enclosing the lower portion of the Achilles tendon. The area located between stiffening member 40 and the rest of shell 20 and outlined by dotted line 44 represent the portion where the two thermoplastics overlap and are chemically bonded together. Compatible materials may be manufactured by successive injections into the same mold. The technique of successive injection molding results in a shell 20 having a single layer as opposed to superimposing two materials thereby obtaining two layers. Stiffening member 40 encompasses the entire sole 32, ankle counter 24 and the rear portion of heel counter 22 which links together sole 32 and ankle counter 24. Stiffening member 40 provides added rigidity to sole 32 and provides lateral support to the ankle of the foot.

Figure 2:
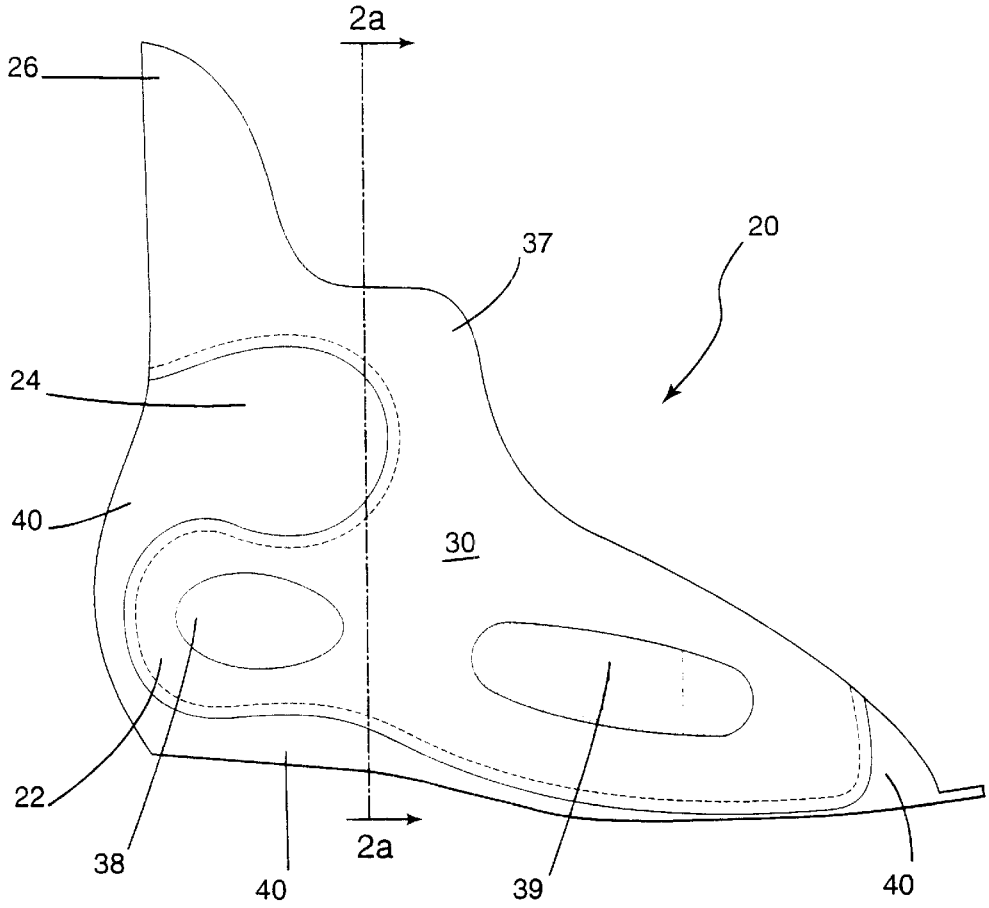
FIG. 2 is a side elevational view of the molded shell shown in FIG. 1.

As shown in FIGS. 1 and 2, ankle counter 24 which is part of stiffening member 40 is separated from the heel portion of sole 32 on each side of shell by the softer thermoplastic. This configuration allows greater flexibility of the ankle relative to the foot in the forward direction as well as in torsion, while providing the necessary lateral support of the ankle. Variation of the thickness of stiffening member 40 also provided a means of controlling its rigidity. For instance, ankle counter 24 is preferably about 2.5 mm whereas sole 32 is about 4 or 5 mm in thickness.

Edges 34 and 36 of shell 20 may also be slightly thicker than the rest of quarters 28 and 30 as these areas will later be provided with lace eyelets where tension will be applied during tightening of the skate boot. Increasing the thickness of these areas reinforces these locally solicited areas so that quarter 28 and 30 will be better suited to resist the tension of laces. A more resilient material may also be used to reinforce these areas.

Figure 2A:
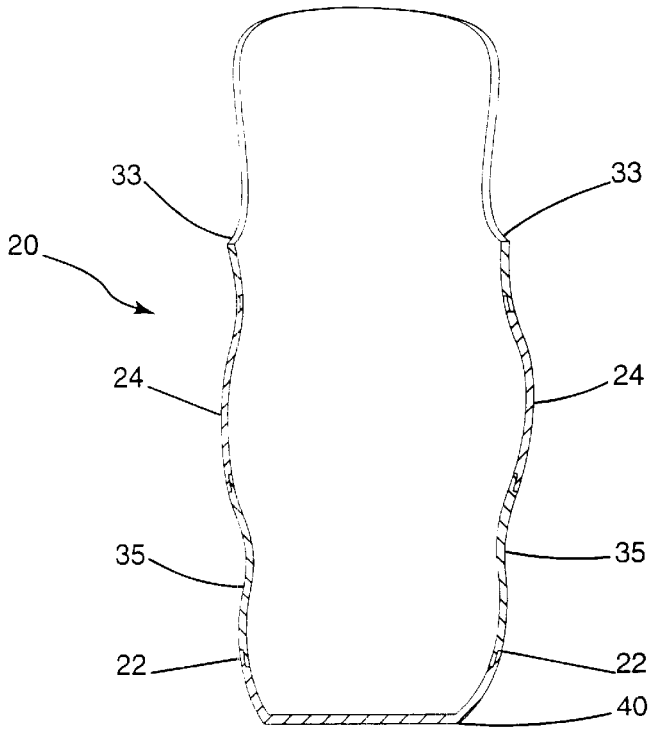
FIG. 2*a* is a sectional view of the molded shell taken along line a—a of FIG. 2.

As shown specifically in FIG. 2*a* which is a sectional view of shell 20 taken at line a—a, the profile of each side of shell 20 is such that it follows the general curves of the ankle and heel. This results in an increased lateral support to the wearer's foot while also providing increased comfort, as no pressure points are created. As a further refinement, the upper edges 33 are curved outwardly thereby avoiding pressure points along the sides of the lower leg, which could result from lateral motion of the wearer's leg. Ankle counter 24 moulds the outward curves of each malleoli of the foot. Shell 20 extends downwardly from ankle counter 24 into depression areas 35 which follows the contours of the lower ankle leading to the heel counter 22 enclosing and supporting the heel of the foot. Shell 20 is ergonomically designed to generally follow the anatomical contour of a human foot and ankle thereby providing uniform support and avoiding the creation of pressure points which often results from plastic reinforcement used in footwear.

FIGS. 3*a* to 3*d* illustrate variations of the shape of shell 20 to accommodate various types of footwear. A shell 200 is designed for a walking boot, a hiking boot or an in-line roller skate. Shell 200 does not feature a tendon guard and therefore provides less support in the back portion of the lower leg. Shell 200 is less restrictive as is required for hiking boot and in-line roller skate. Shell 110 is designed for a shoe of a lesser height such as a running shoe, a soccer shoe, a football shoe, baseball shoe, a golf shoe or a regular walking shoe. Both shells 200 and 110 have variable wall thickness to provide more or less flexibility to specific areas of the footwear as dictated by the activity it is designed for. Both shells 200 and 110 also feature stiffening members 215 and 122, respectively, which are similar to stiffening member 40 of shell 20 previously described with reference to FIG. 1. It should be noted that a stiffening member is not essential for footwear requiring minimal support and added flexibility. For instance, a regular walking shoe may require very little lateral support and a very flexible sole. This type of footwear could have a shell 110 made of a single thermoplastic of variable thickness.

Figure 3:
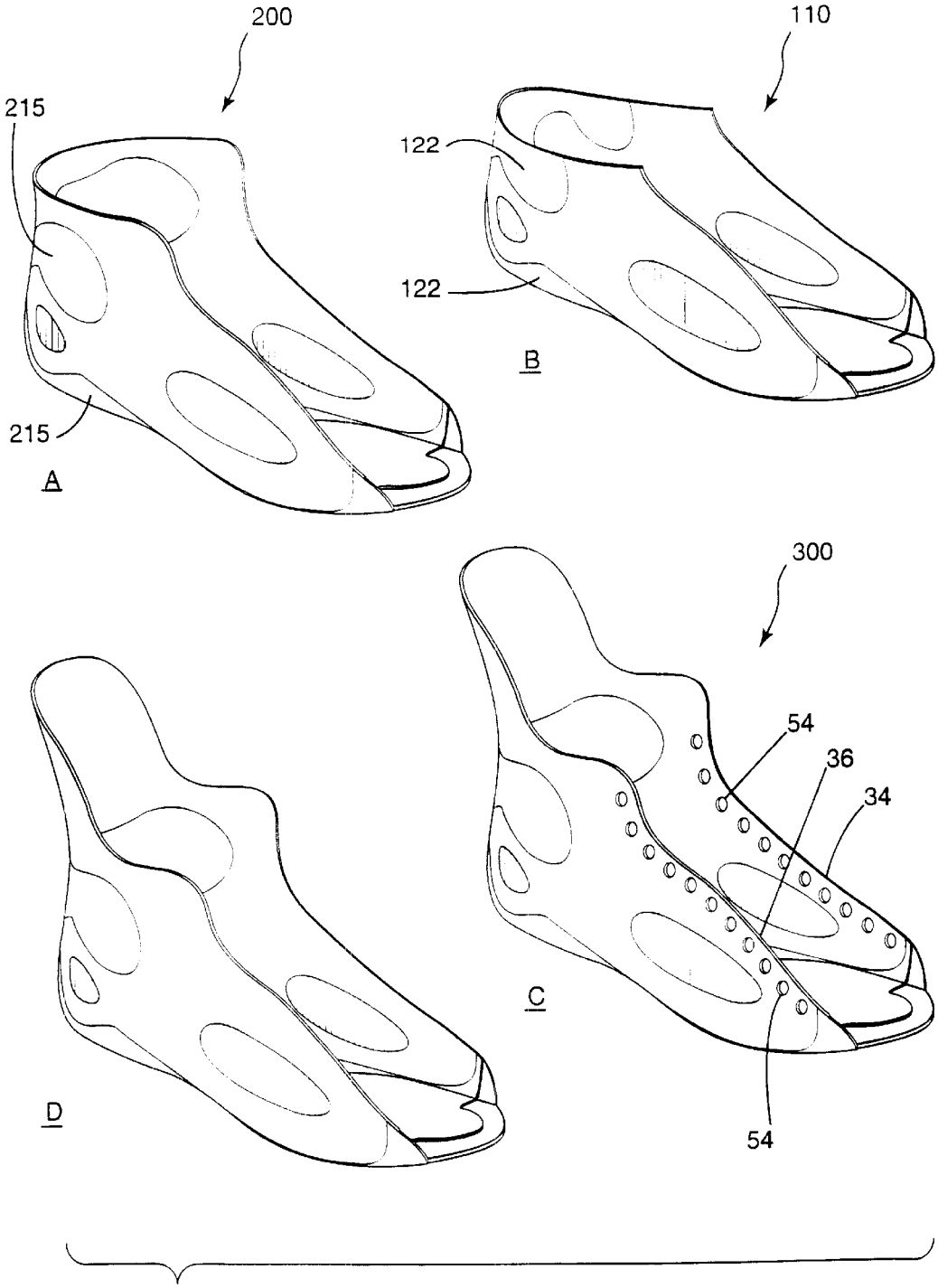
FIG. 3*a* is a perspective view of a second embodiment of a molded shell in a sport footwear according to the invention.
FIG. 3*b* is a perspective view of a third embodiment of a molded shell in a sport footwear according to the invention.
FIG. 3*c* is a perspective view of a fourth embodiment of a molded shell in a sport footwear according to the invention.
FIG. 3*d* is a perspective view of the first embodiment of a molded shell in a sport footwear according to the invention.

A shell 300 similar to shell 20 on FIG. 1 is also illustrated in FIG. 3*c* which features a row of lace eyelets 54 along each edge 34 and 36. Lace eyelets are normally made later on in the process of making the footwear but can be previously perforated if needed.

Figure 5A:
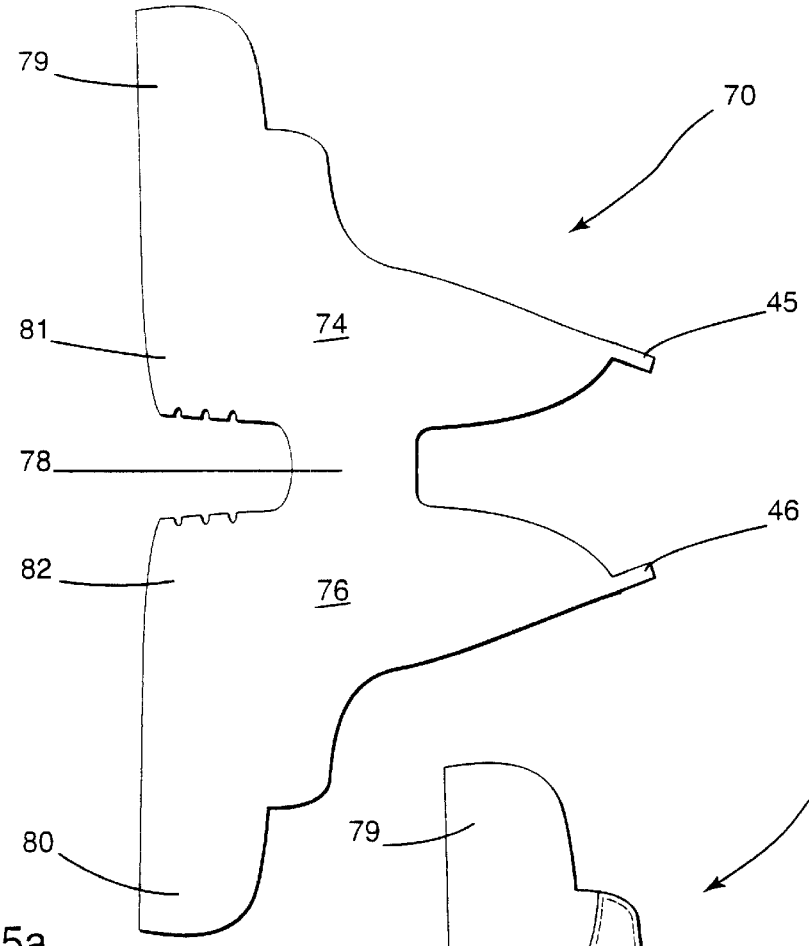
FIG. 5*a* is a top plan view of a skin component for a sport footwear according to the invention.
Figure 5B:
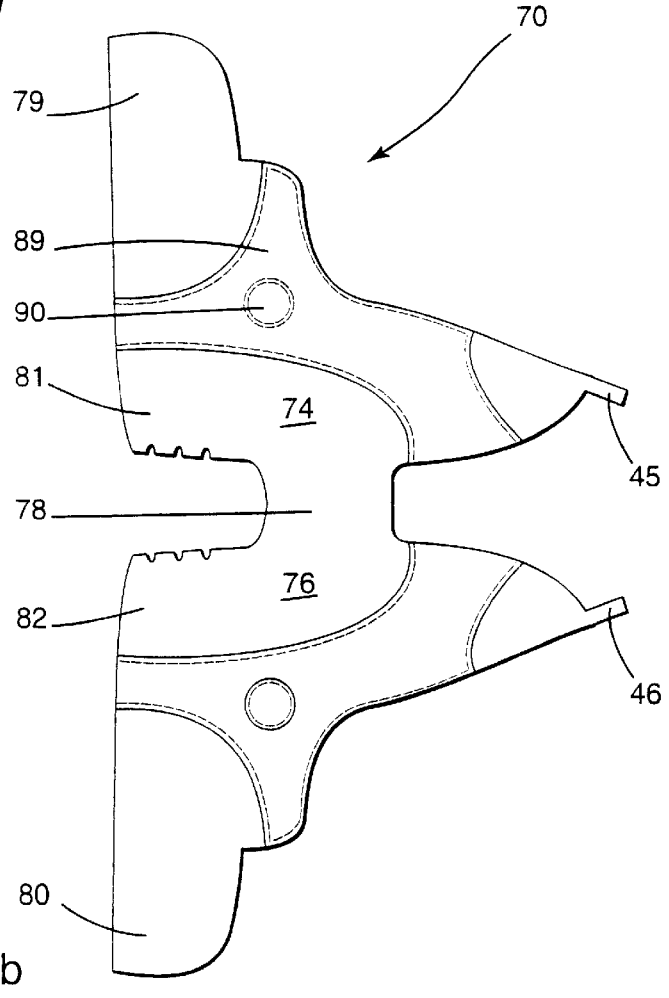
FIG. 5*b* is a top plan view of the skin component shown in FIG. 5*a* with added decorative components.
Figure 5C:
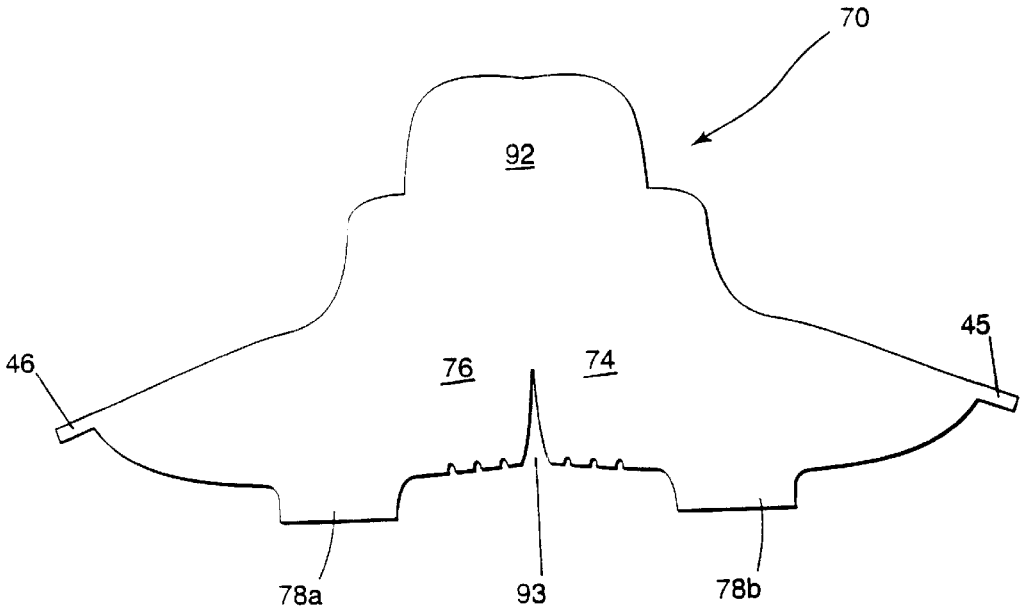
FIG. 5*c* is a top plan view of a second embodiment of a skin component for a sport footwear according to the invention.
Figure 5D:
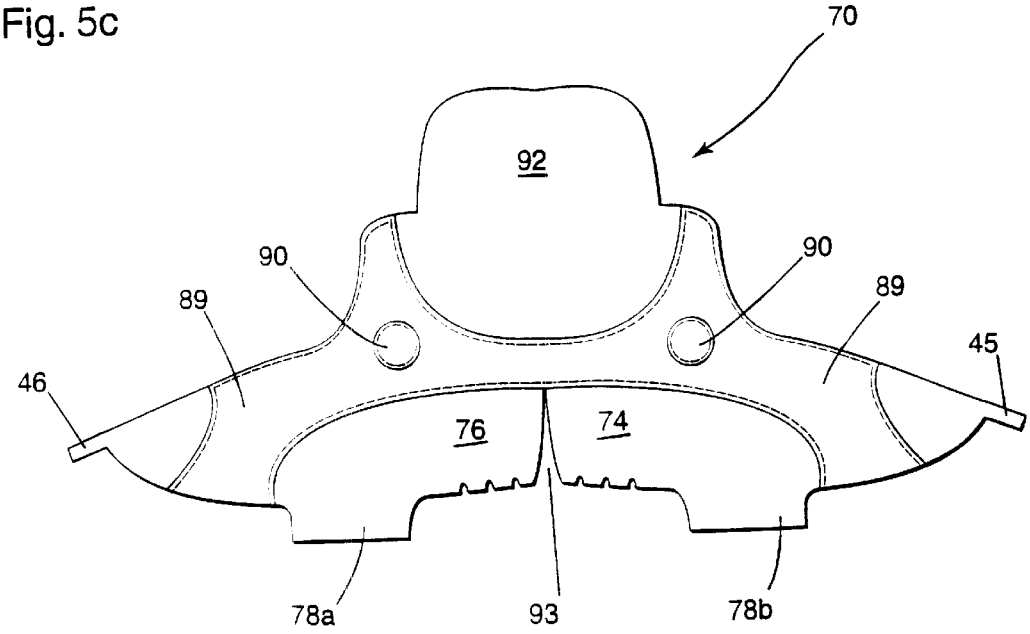
FIG. 5*d* is a top plan view of the skin component shown in FIG. 5*c* with added decorative components.
Figure 6:
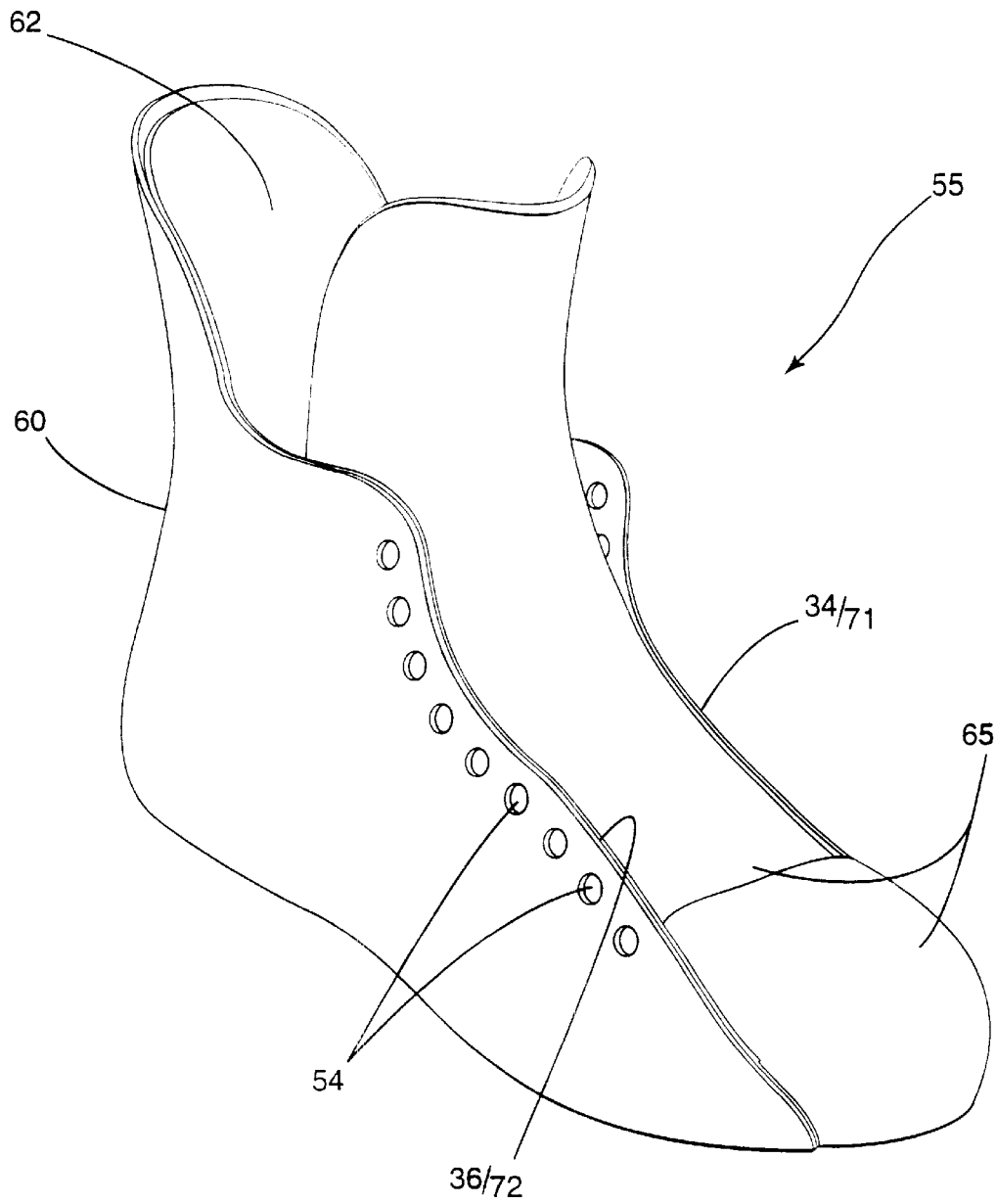
FIG. 6 is a perspective view of a first embodiment of the assembled upper portion of a sport footwear according to the invention.

With reference to FIGS. 4 to 6, a skate boot 55 will now be described. FIG. 4 is an exploded view of the various elements which constitute skate boot 55. shell 20 is the central structural element of a skate boot so constructed. A skin assembly 60 preferably made of synthetic fabric or technical textile material such as nylon, aramid textile used with or without a thermoplastic sheet backing. Skin assembly 60 is cut and assembled to conform to the outer wall of shell 20, is positioned over shell 20 and affixed or glued in place. Skin assembly 60 is essentially non-structural and is provided to enhance the aesthetics of the skate boot.

A lining 62 made of a foam material shaped to precisely conform to the inside of the rear portion of shell 20, extends from tendon guard 26 down to sole 32 and covers both sides of the ankle area. Lining 62 is glued inside shell 20. A footbed 58 also made of a foam material and having an inner surface conforming to the exact contour of a human foot is positioned on sole 32, inside shell 20. Footbed 58 comprises a sole 59 and a sidewall 61 extending along each side and around the heel portion of footbed 58. While lining 62 is glued to the inside of shell 20, footbed 58 is removable from inside shell 20. The bottom surface of footbed 58 which is in contact with sole 32 when inserted into shell 20, can be made of a non-skid material such as a material having a high friction coefficient or a partially adhesive material which ensures that footbed 58 will not move inside shell 20 during use. A section 64 on both sides of footbed 58 partially overlaps lining 62 when footbed 58 is inserted into shell 200.

A tongue/toe box assembly 65 comprising a tongue 68 and a rigid toe protector 67 affixed to tongue 68 is installed over the front portion of shell 20. Toe protector 67 is inserted into receptacle groove 31 and between quarters 28 and 30 and affixed or fastened to shell 20 thereby connecting the entire tongue/toe box assembly 65 to shell 20. Tongue 68 extend all the way down to the bottom of toe protector 67 to cover and cushion the toe area of the skate boot and ensure that the wearer's toes will not touch the plastic toe protector 67.

The assembly usually follows this general sequence: The skin assembly 60 is first affixed to shell 20. Lining 62 is then glued inside shell 20. Lace eyelets 54 are punched into each edge 34/71 and 36/72 of the pre-assembly as is shown in FIGS. 6, 7, 8 and 9 and tongue/toe box assembly 65 is installed onto shell 20. A ground engaging implement such as an ice runner holder 84 or 86 or an in-line wheel chassis 85, or an outsole is mounted to sole 32 of shell 20. Finally, footbed 58 is inserted into shell 20 to complete the skate. Of course, variations of this sequence are possible and depend on the manner in which the ground engaging implement is mounted to the boot and also on the manufacturing equipment available.

FIG. 5*a* illustrates a skin 70, which has been cut from a flat piece of synthetic fabric or textile material. The cutting operation of skin 70 is adapted to be fully automated since it is performed on a flat surface. Skin 70 comprises a right quarter 74 and a left quarter 76 linked together by a bridge portion 78. Each quarter 74 and 76 further comprises half-tendon guards 79 and 80 respectively. The heel portions 81 and 82 of each quarter 74 and 76 is given a slightly curvilinear profile to enable the formation of a rounded heel counter which conforms to the heel counter 22 profile of shell 20 shown in FIGS. 1 and 2.

FIG. 5*b* illustrates a skin 70 to which decorative components 89 and 90 were added. Decorative components 89 and 90 are assembled to skin 70 by automated process such as automatic stitching or welding. The automation of this process is again simplified because it is done on a flat surface. Components 90 may be stitched, welded or glued to components 89 in a first step then the assembly of components 89 and 90 may be assemble to skin 70 in a final step. Of course, the assembly of the various decorative components may be performed in any order to adapt to the specific physical requirements of available manufacturing equipment. It can also be done all at once. The flexibility of fabrication of the skin assembly 60 is due primarily to the fact that all the assembly operations, including the cutting of skin 70, are performed while the fabric material is laying down flat. FIG. 5*b* illustrates the decorative components 89 and 90 stitched to skin 70 as shown by the stitching lines by way of example only. Decorative components 89 and 90 could be welded or glued or otherwise affixed to skin 70 in any known fashion without departing from the principle of assembling as many if not all skin components while the various pieces are flat and therefore easy to work. The process is thereby simplified and can readily be automated.

Skin 70 is folded around bridge portion 78 and sewn along half-tendon guard 79 and 80 to form skin assembly 60. Extensions 45 and 46 are also sewn together at the front of skin assembly 60.

FIGS. 5*c* and 5*d* illustrate a variation of a skin 70. The right quarter 74 and the left quarter 76 are, in this case, are linked together at tendon guard 92, which is the equivalent of the assembly of half-tendon guard 79 and 80 of FIGS. 5*a* and 5*b*. Half-bridge portions 78A and 78B are provided at the lower part of each quarter 74 and 76, to be sewn together later on to form skin assembly 60 shown in FIG. 4. In this variation the heel portions 81 and 82 are separated by a cut-out portion 93 which has curvilinear walls to enable the formation of a rounded heel counter as previously mentioned when referring to the curvilinear profile of heel portions 81 and 82 shown in FIGS. 5*a* and 5*b*.

FIGS. 5*c* and 5*d* illustrate each quarter 74 and 76 having a similar profile to quarters 74 and 76 of skin 70 shown in FIGS. 5*a* and 5*b*. FIG. 5*c* illustrates a skin 70 made from a single flat piece of fabric or textile material whereas FIG. 5*d* illustrates a skin 70 with decorative components 89 and 90 added in the same fashion as previously described in FIG. 5*b*.

Skin 70 is cut, as its profile indicates, to conform to the general shape of shell 20. The profile and shape of skin 70 may vary according to the shell 20 it is intended for. As a further variation of skin 70, quarters 74 and 76 may be two single pieces joined together by a third piece covering bridge portion 78.

The flat skin 70 is folded at the bridge portion 78 and sewn at the rear edges of cuff portions 79 and 80, at heel portions 81 and 82, and at the extensions 45 and 46 to form a skin assembly 60 as shown in FIG. 4, which can be positioned over and affixed to shell 20. Similarly, if the variant shown in FIGS. 5*c* and 5*d* is used, flat skin 70 is folded at tendon guard 92, the two half-bridges 78A and 78B and the two extensions 45 and 46 are sewn together to form a skin assembly 60 as shown in FIG. 4, which can be positioned over and affixed to shell 20.

Skin assembly 60, once formed, preferably has openings in its bottom portion to provide direct access to shell 20 when fastening an ice runner holder 84 or 86, or an in-line wheel chassis 85 to the skate boot. Skin assembly 60 is positioned over shell 20 and conforms to the shape of shell 20. The general shape of skin assembly 60 ensures a reasonably good alignment between the two components however positioning pins (not shown) may be added to shell 20, which are inserted into corresponding apertures of skin assembly 20 so as to precisely align the two parts, ensuring consistent assembly.

FIG. 6 illustrates the completed skate boot 55 without its ground-engaging implement. Skin assembly 60 is affixed to shell 20 and conforms exactly to the shape given by shell 20. Lace eyelets 54 were perforated or punched along the edges 34/71 and 36/72 using a automatic punch which guides itself along the edge and rapidly perforates a series of eyelets 54 equally spaced apart. Lining 62 is affixed inside shell 20 and cushions the wearer's heel, ankle and lower leg. Tongue/toe box assembly 65 is installed to the front portion of shell 20 to cover and cushion the entire frontal area of the wearer's foot and ankle. The resulting boot is light, comfortable and provides the required support for skating.

Figure 7:
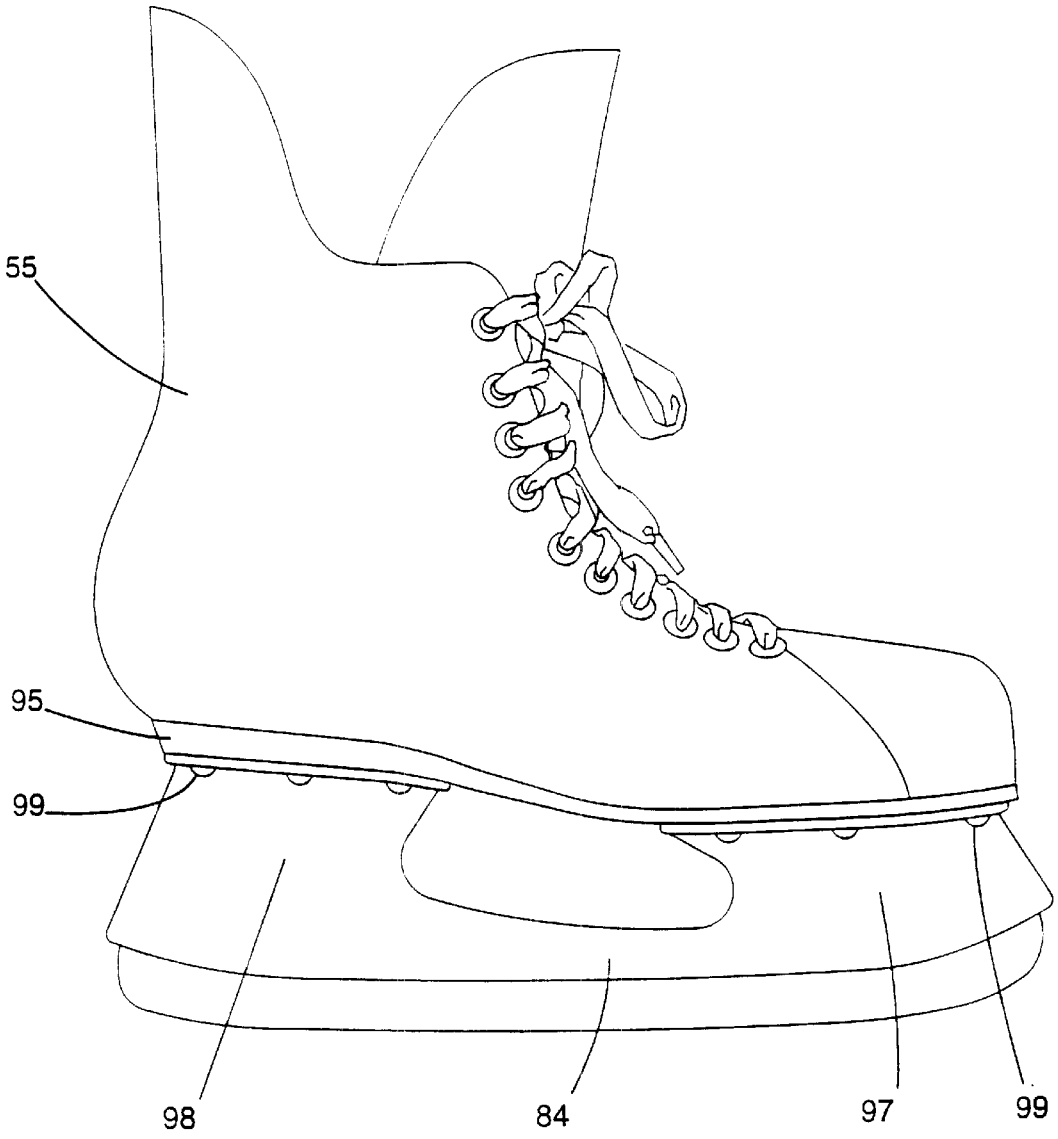
FIG. 7 is a side elevational view of the assembled upper portion of sport footwear illustrated in FIG. 6 shown with an ice skate runner.

FIG. 7 illustrates a skate boot construction according to the invention to which a standard ice runner holder 84 having a front pedestal 97 and a rear pedestal 98, is mounted. An outer sole 95 is first glued or nailed to the bottom of skate boot 55 to provide added thickness enabling ice runner holder 84 to be riveted to skate boot 55 with rivets 99. Outer sole 95 and front and rear pedestal 97 and 98 are provided with corresponding apertures to insert rivets 99 and fasten ice runner holder 84 to skate boot 55.

Figure 8:
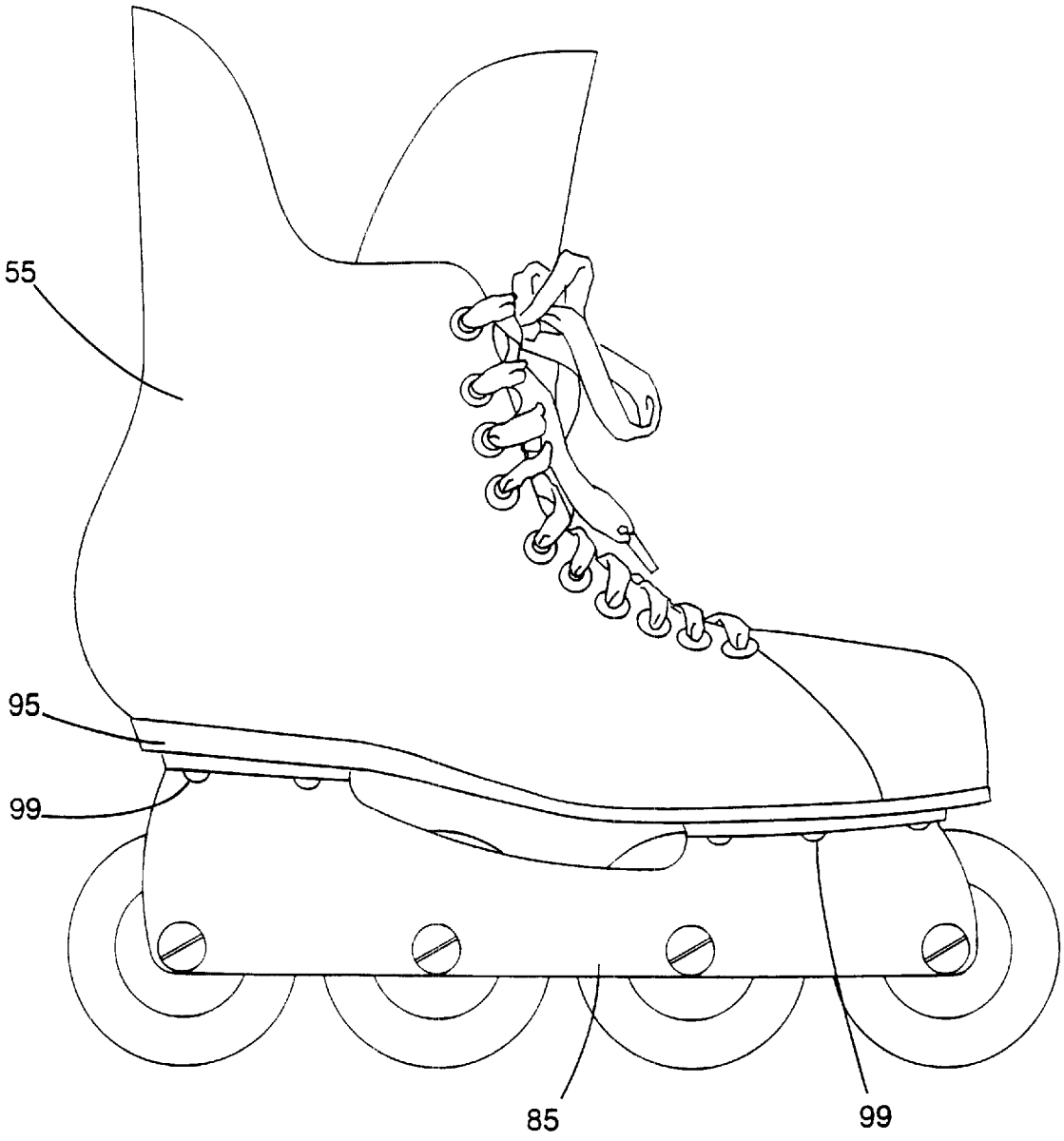
FIG. 8 is a side elevational view of the assembled upper portion of a sport footwear illustrated in FIG. 6 shown with an in-line roller chassis.

Similarly, FIG. 8 illustrates skate boot 55 to which an in-line wheel chassis 85 is mounted. An outer sole 95 is first glued or nailed to the bottom of skate boot 55 to provide added thickness and the in-line wheel chassis 85 is riveted to skate boot 55 using rivets 99.

Figure 9:
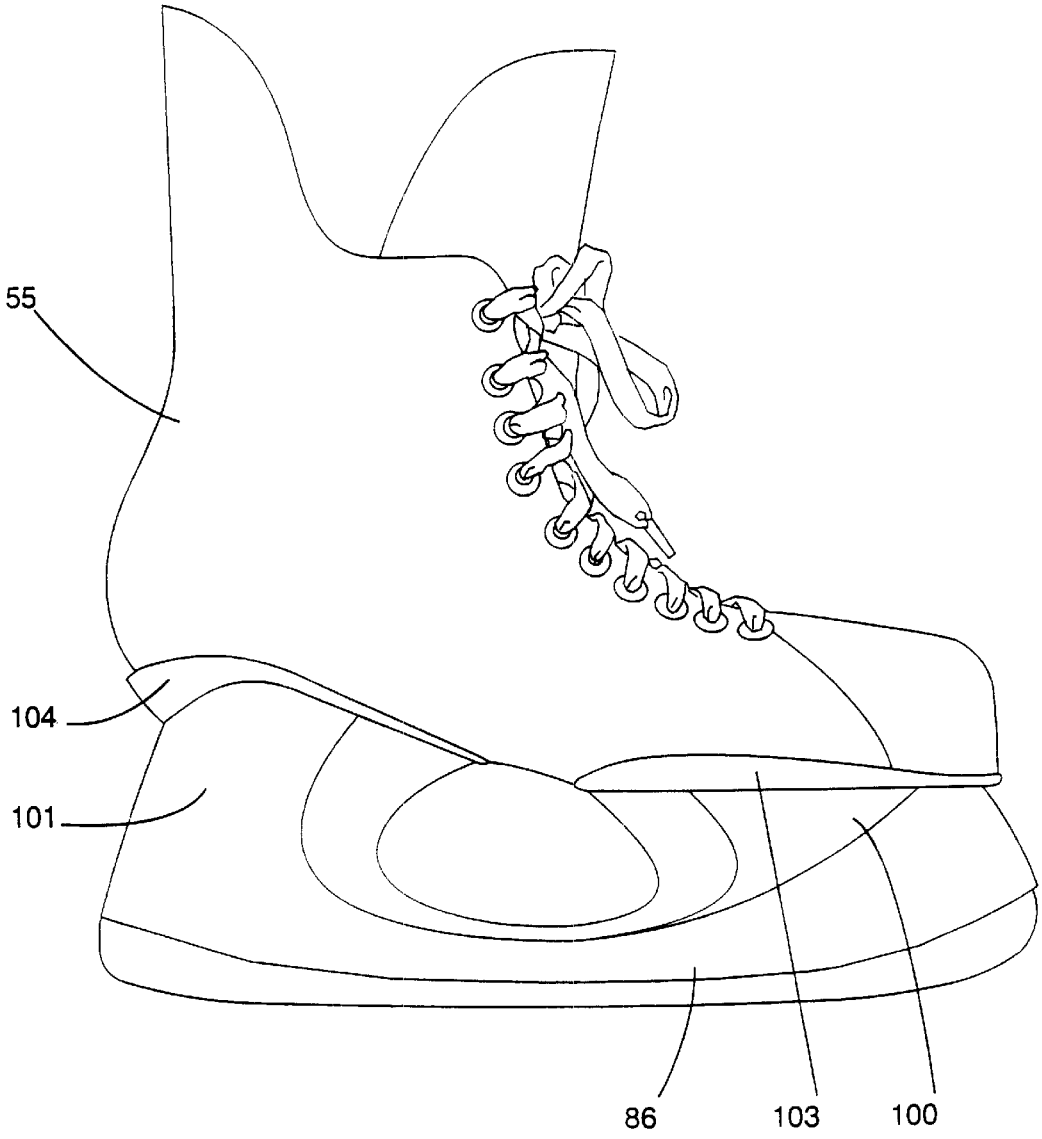
FIG. 9 is a side elevational view of the assembled upper portion of a sport footwear illustrated in FIG. 6 shown with a second type of ice skate runner.

FIG. 9 illustrates an ice runner holder 86 having a front pedestal 100 and a rear pedestal 101 that are shaped to conform more specifically to the contours of skate boot 55. A front spacer 103 and a rear spacer 104 are positioned in between ice runner holder 86 and skate boot 55. Ice runner holder 86 is mounted to skate boot 55 by internal fasteners, which connect ice runner holder 86 directly to the bottom of shell 20. Since skin assembly 60 extend underneath shell 20, the space between front and rear pedestals 100 and 101 is cover by the textile material giving the skate an aesthetic look.

Figure 10:
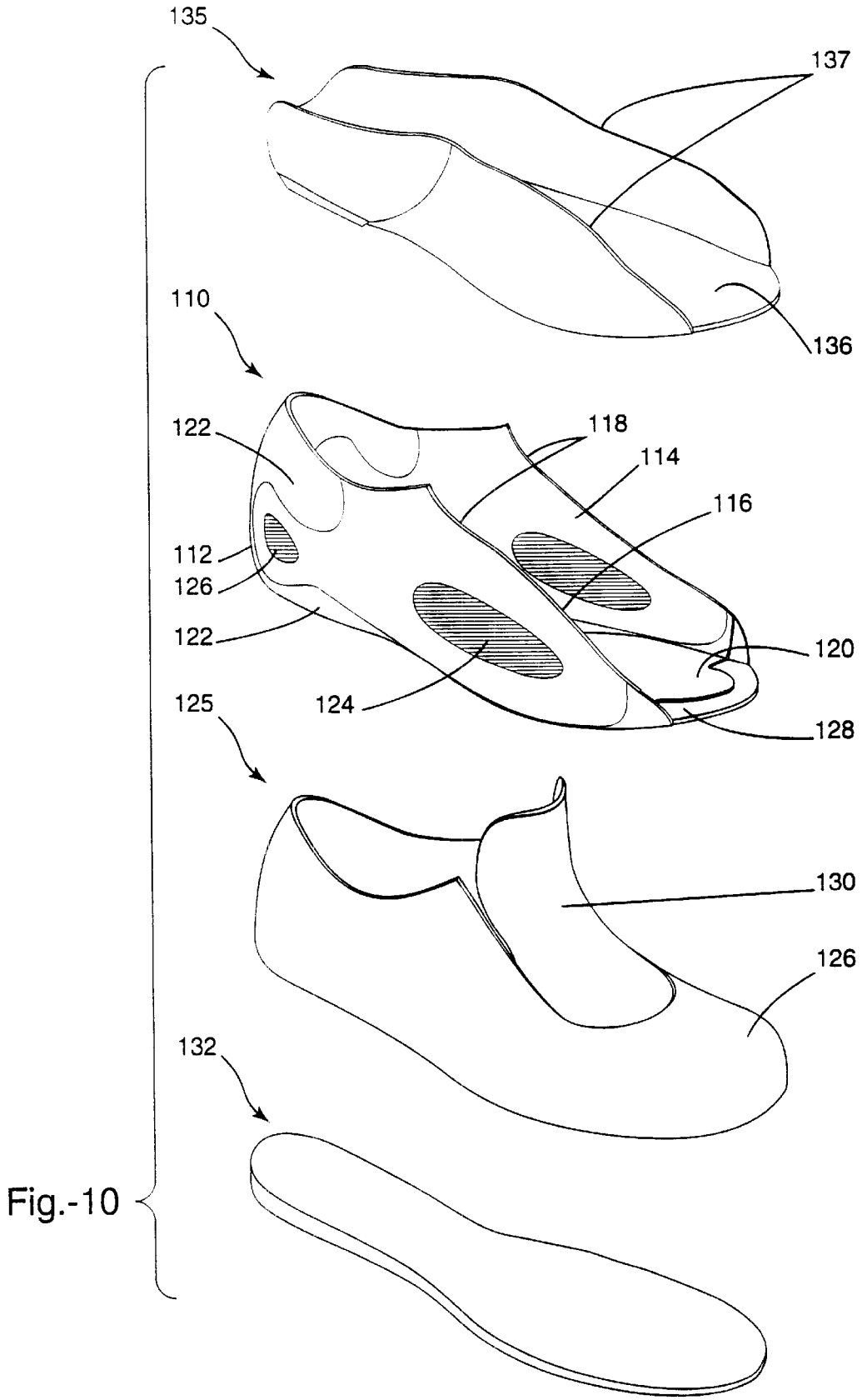
FIG. 10 is an exploded view of a second variant of a sport footwear construction according to the invention.
Figure 11:
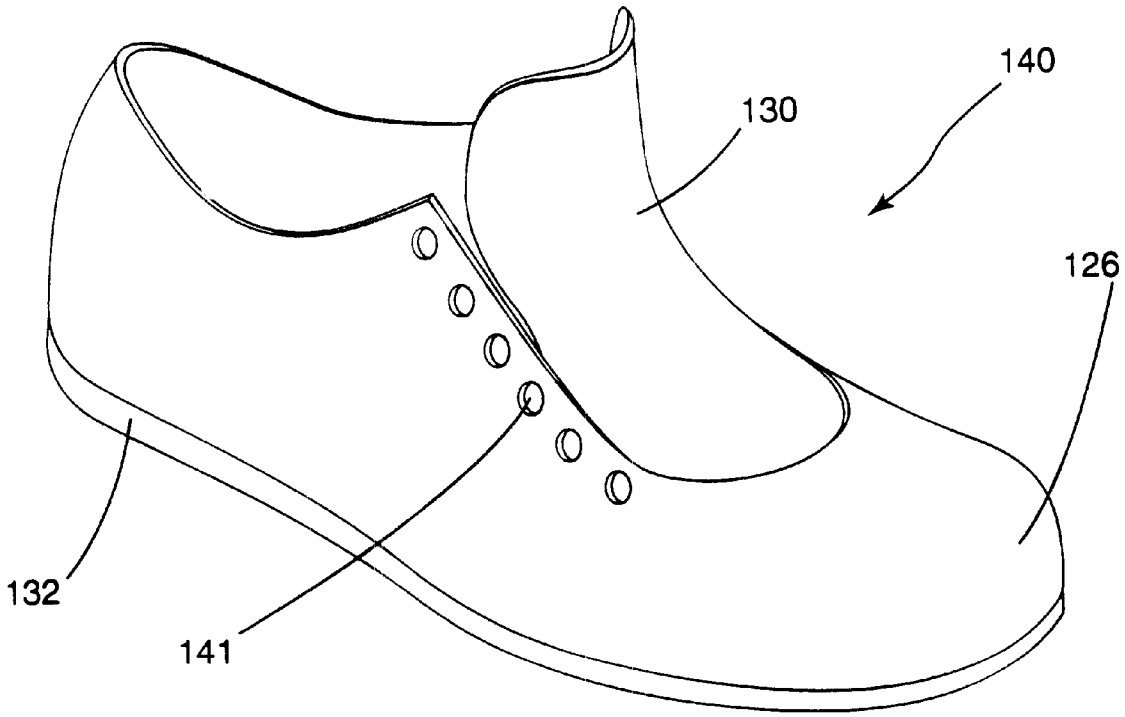
FIG. 11 is a perspective view of a second variant of an assembled sport footwear according to the invention.
Figure 12:
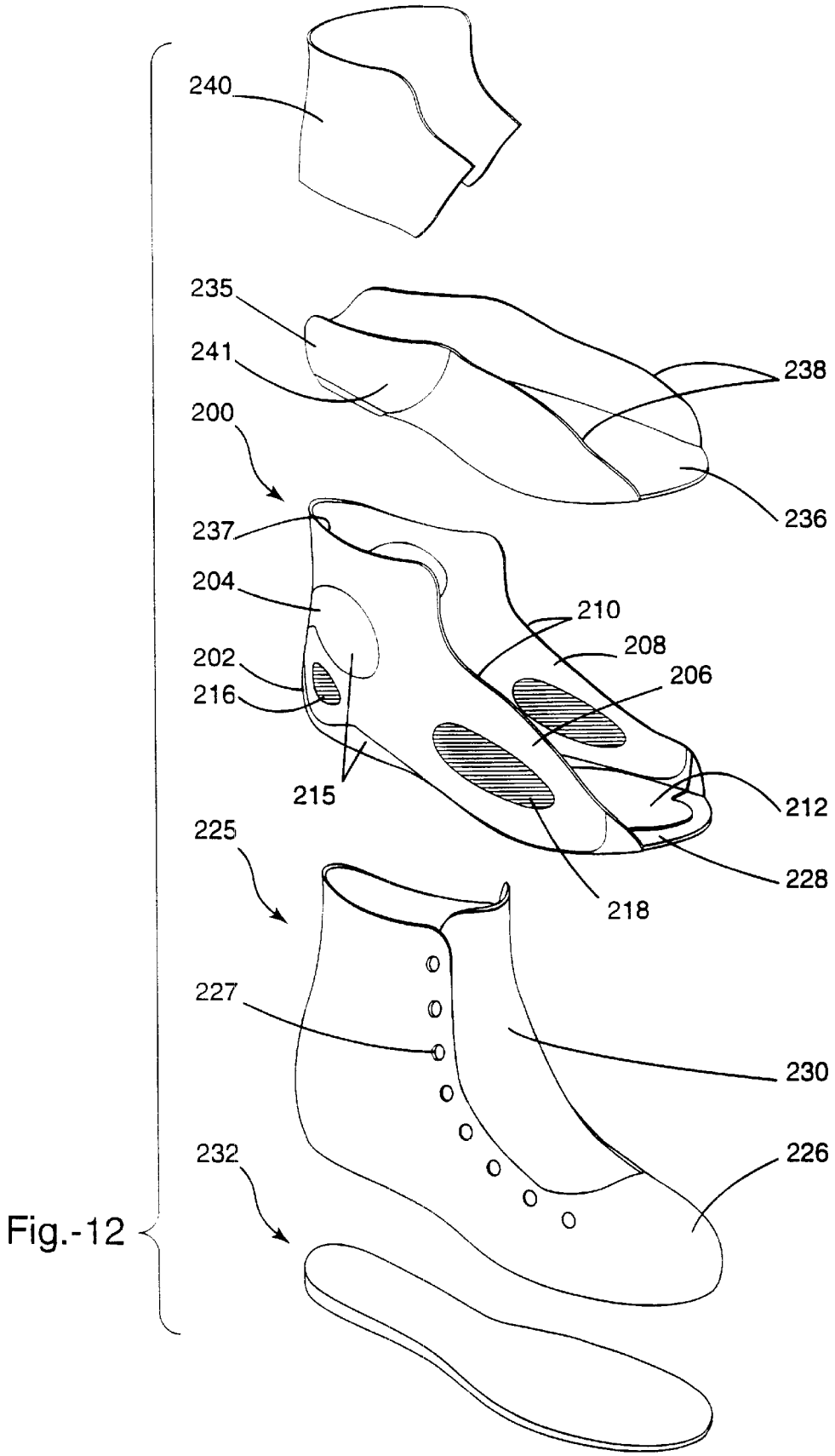
FIG. 12 is an exploded view of a third variant of a sport footwear construction according to the invention.

FIGS. 10 and 11 illustrate the various components necessary to make a low-cut footwear according to the invention. A molded shell 110 preferably made of injected thermoplastic, having a low-cut profile corresponding to the general outer shape of a shoe is shown. Shell 110 comprises a heel counter 112, a medial quarter 114 and a lateral quarter 116, both of variable thickness extending longitudinally from heel counter 112 to the front portion of shell 110. Quarters 114 and 116 have edges 118 defining the main opening for insertion and removal of the foot. A sole 120 extends the entire length of shell 110. Shell 110 as shown comprises a stiffening member 122 which encompasses sole 120 and the upper portion of heel counter 112. Stiffening member 122 is made of a more rigid thermoplastic to provide added support to the wearer's foot. As previously mentioned, depending on the sporting activity the footwear is designed for, a supporting member 122 made of a more rigid material may not be required. For instance, a simple walking shoe does not require added support as a soccer or football shoe does. As previously described, variations of shell 110's wall thickness, variations of materials, or combination of two or more materials are methods of changing and adapting the physical properties of shell 110 and of the footwear so constructed for its intended use. Shell 110 is shown with thinned wall regions 124 and 126 that provides added flexibility in areas corresponding to bone pressure points.

Shell 110 is the central component of the shoe to be constructed. It is molded to conform to the shape of the foot and its shape dictates the general shape of the footwear. Shell 110 further provides the supporting structural element of the footwear.

An outer cover 125 made of a single layer or multiple layers of fabric, textile or leather material, which may or may not be decorated with various other components, is used to cover shell 110. Outer cover 125 encloses the entire shell 110 and only requires minor shaping of the toe box 126 which may easily be achieved with a more or less rigid toe protector sewn or affixed inside toe box 126. Preferably, the toe protector is shaped to fit within the receptacle groove 128 of shell 110. A softer, more flexible toe protector is used for walking or golfing shoe for instance as these types of shoes do not require solid frontal protection. On the other hand, a soccer or football shoe, and to a lesser extent, a baseball shoe will be fitted with a more rigid plastic toe protector similar to toe protector 67 used for skate boot 55. Outer cover 125 further comprises a tongue 130, which cushions and covers the frontal portion of the wearer's foot. Tongue 130 is sewn or otherwise affixed to the front portion of outer cover 125. Outer cover 125 is glued to shell 110 so that it will conform to the shape defined by shell 110.

An outer sole 132 of a specific configuration dictated by the sport the footwear is intended for is glued or nailed to the assembly of shell 110 and outer cover 125. For illustrative purposes, a simple walking shoe sole is show. However the footwear is adapted to accommodate a variety of outer soles 132 featuring various types of spikes for football, baseball or soccer shoes or studs for golf or track and field shoes.

Finally, a footbed 135, which is adapted to conform to the interior space of shell 110, is inserted into the assembly of shell 110, outer cover 125 and outer sole 132 to provide the necessary level of comfort and the necessary level of support for the arch of the foot. Footbed 135 is made of a foam material. It has an inner surface conforming to the contour of a foot. Footbed 135 comprises a sole 136 and a sidewall 137 extending along each side and around the heel portion of footbed 135. The bottom surface of footbed 135 which is in contact with sole 120 when inserted into shell 110, can be made of a non-skid material or partially adhesive material which ensures that footbed 135 will not move inside shell 110 during use. Footbed 135 may further comprise a frontal enclosing portion that covers the entire toe area of shoe 140. Preferably, sidewall 137 and tongue 130 abut one another when shoe 140 is laced up or fastened. Lace eyelets 141 are perforated into each side of shoe 140 using an automatic punch which guides itself along the edge and rapidly perforate a series of eyelets 141 equally spaced apart.

FIGS. 12 to 15 illustrate another embodiment of a footwear construction according to the invention. The various components necessary to make a short boot are shown in an exploded view. A molded shell 200 is preferably made of injected thermoplastic and is the central component of the boot to be constructed. It is molded to conform to the shape of the foot and its shape dictates the general shape of the final boot 250. Shell 200 provides the supporting structural element of the footwear. Shell 200 comprises a heel counter 202, an ankle counter 204, a medial quarter 206 and a lateral quarter 208, both of variable thickness extending longitudinally along each side of shell 200, from the back of shell 200 to the front portion of shell 200. Quarters 206 and 208 have edges 210 defining the main opening for insertion and removal of the foot. A sole 212 extends the entire length of shell 200. Shell 200 as shown, comprises a stiffening member 215, which forms sole 212 and ankle counter 204. Stiffening member 215 is made of a more rigid thermoplastic than the rest of shell 200 to provide added support to the wearer's foot. As previously mention, depending on the sporting activity the boot is designed for, a supporting member 215 made of more rigid material may or may not be required. For instance, a boot designed for an in-line roller skate as shown in FIG. 16 requires added support to provide a boot having good performance. As previously described, variations of shell 200's wall thickness, variations of materials, or combination of two or more materials are methods of changing and adapting the physical properties of shell 200 and of the boot so constructed for its intended use. Shell 200 is shown with thinned wall regions 216 located between ankle counter 204 and the heel portion of sole 212 to provide more flexibility in this area of bone pressure point. Another thinned wall area 218 is provided to increase flexibility of shell 200 around the widening portion of the foot corresponding to another bone pressure point.

At the opposite end of the spectrum, a walking boot or hiking boot as shown in FIG. 16 does not require the added support of stiffening member 215. Shell 200 can be made of a single thermoplastic having various thicknesses in selected areas such as 216 and 218. Shell 200 so constructed provides the necessary support while also providing overall flexibility.

Shell 200 is inserted into an outer cover 225 made of a single layer or multiple layers of fabric, textile or leather material, which may or may not be decorated with various other components. Outer cover 225 has been previously assembled and shaped and further comprises a reinforced toe box 226 provided which by a more or less rigid toe protector sewn or glued inside toe box 226. Preferably, the toe protector is shaped to fit within the receptacle groove 228 of shell 200. Outer cover 225 further comprises a tongue 230, which cushions and covers the frontal portion of the wearer's foot. Tongue 230 is sewn or otherwise affixed to the front portion of outer cover 225. Outer cover 225 is glued to shell 200 so that it will conform to the shape defined by shell 200.

An outer sole 232 of the specific configuration required for the final footwear is glued or nailed to the assembly of shell 200 and outer cover 225. For illustrative purposes, a thin sole 232 for in-line roller skates is shown. However, the footwear is adapted to accommodate a variety of outer soles.

A lining 240 made of a foam material is shaped to precisely conform to the inside of the rear portion of shell 200 and extends from the upper edge 237 of shell 200 down to the sole 212. Lining 240 cushions both sides of the ankle area and is glued inside shell 20.

A footbed 235 is inserted inside shell 200. Footbed 235 is made of a foamy material and comprises an inner surface conforming to the exact contours of a foot thereby providing comfort to boot 250. Footbed 235 comprises a sole 236 and a sidewall 238 extending along each side and around the heel portion of footbed 235. The bottom surface of footbed 235 which is in contact with sole 212 when inserted into shell 200, can be made of a non-skid material or partially adhesive material which ensures that footbed 235 will not move inside shell 200 during use. A section 241 of footbed 235 overlaps lining 240 when positioned inside shell 200.

Figure 13:
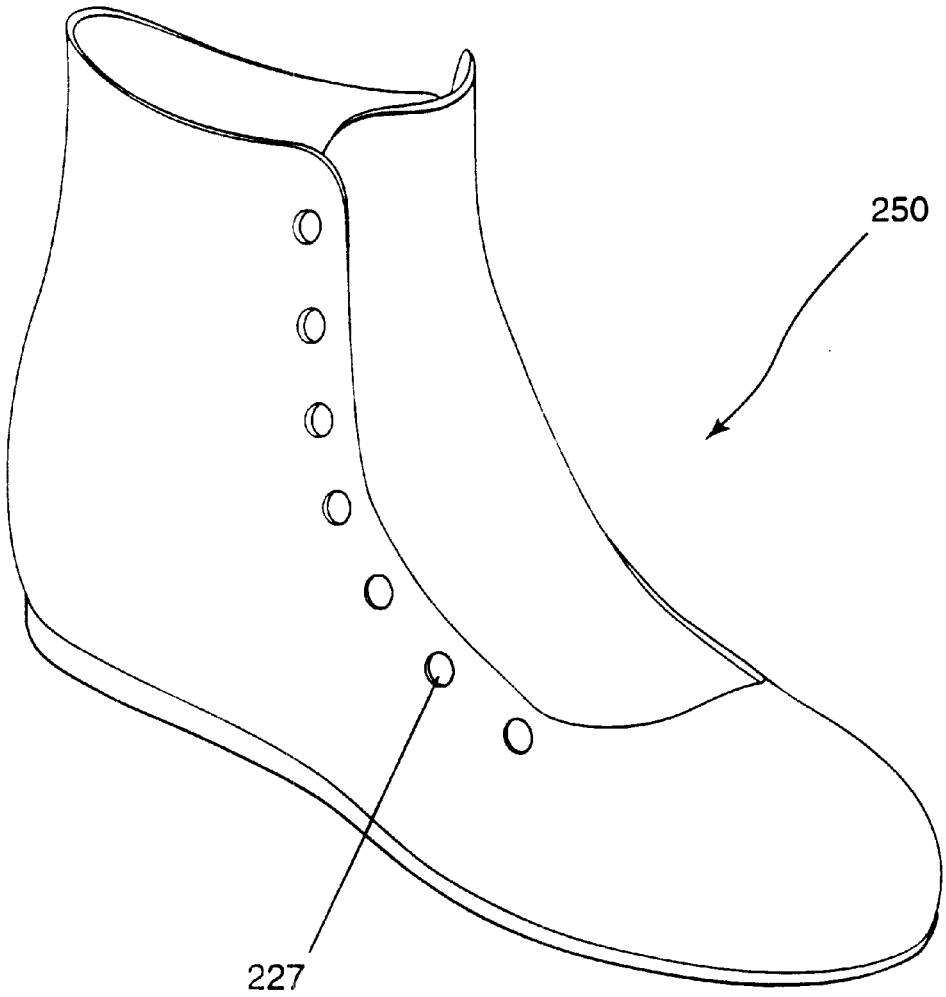
FIG. 13 is a perspective view of a third variant of an assembled sport footwear according to the invention.

FIG. 13 illustrates a boot 250 resulting from the assembly of the various parts described above. As previously described, lace eyelets 227 may be perforated before or after assembly of outer cover 225 to shell 200.

Figure 14:
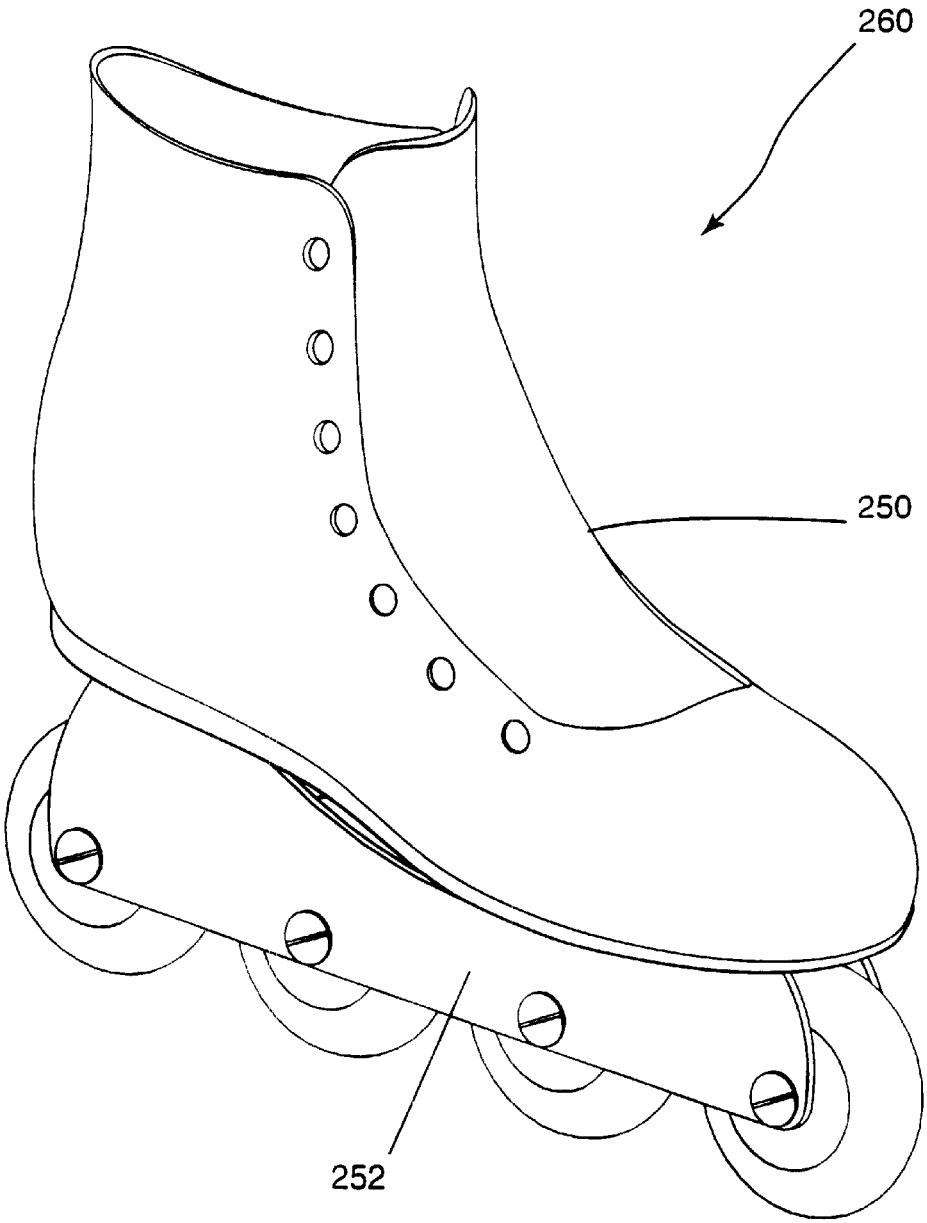
FIG. 14 is a perspective view of the assembled sport footwear illustrated in FIG. 13 shown with an in-line roller chassis.
Figure 15:
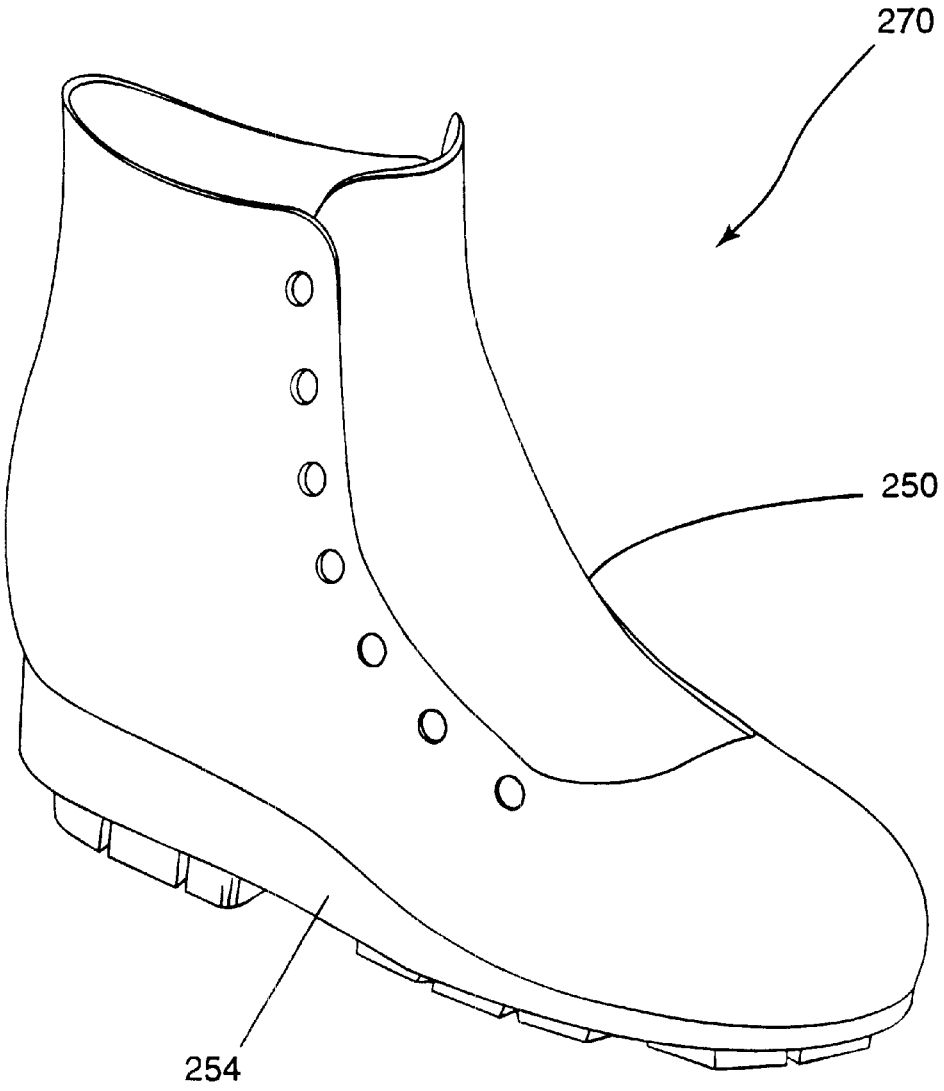
FIG. 15 is a perspective view of the assembled sport footwear illustrated in FIG. 13 shown made into a hiking boot.

FIG. 14 illustrates an in-line roller skate 260 constructed by assembling an in-line roller chassis 252 to boot 250. FIG. 16 illustrates a walking boot or hiking boot 270 constructed by assembling a specific sole 254 to boot 250.

As can be seen from the description of various embodiments a footwear constructed according to the invention, shell 20/110/200 is the central component. With its use, the manufacturing process is no longer a series of consecutive assembly steps which occur over a form or last of the footwear but is a joining together of a limited number of prefabricated items manufactured separately. This manufacturing process increases the possibilities of automation, as each item is fabricated separately and brought together at the end of the production cycle. Furthermore, the injection molding of shell 20/110/200 reduces the possibilities of errors. Once the mold is optimal, each part being produced from the mold is unlikely to substantially vary. The joining of the outer cover or skin components only requires minimal control of the alignment of the two pre-fabricated parts.

For skate boot 55 shown in FIG. 5, Toe-box/tongue assembly 65 is also manufactured separately and brought to the production line at the end of the production cycle only. Tongue 68 is sewn or glued to toe protector 67. Toe protector 67 is glued or otherwise affixed to the front of shell 20 to complete the skate boot.

This modular approach of the manufacturing process leads to a decrease in rejected items during production, a better control of the end shape and volume of the footwear and of course to a decrease in overall cost as production is rationalized.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A footwear comprising:

(a) a structural molded inner shell for supporting and enclosing a foot having a bottom area, a length, right and left sides, a back, and a toe area, said inner shell having an inner side, an outer side, a sole portion covering the bottom area of the foot, lateral and medial quarters extending along the length of the foot and projecting upwardly from each side of said sole portion to cover the right and left sides of the foot, and a heel counter surrounding the back of the foot and linking said lateral and medial quartets together;

(b) an outer skin permanently bonded onto said outer side of said inner shell, said outer skin comprising right and left quarters that only cover said heel counter and said lateral and medial quarters of said inner shell and extend at least partially but not completely under said sole portion of said inner shell;

(c) a frontal toe portion substantially covering the toe area of the foot;

(d) a tongue covering the upper frontal area of said inner shell; and (e) a ground-engaging supporting element mounted to the bottom of said footwear.

2. A footwear as defined in claim 1 further comprising a footbed cushioning the sole portion and a lower inner portion of each side of said structural molded inner shell.

3. A footwear as defined in claim 1 wherein said structural molded inner shell further comprises an ankle counter located above said heel counter.

4. A footwear as defined in claim 3 wherein said ankle counter surrounds the sides and back of the wearer's ankle and is shaped to overlie the wearer's malleoli.

5. A footwear as defined in claim 4 wherein said structural molded inner shell further comprises depression areas located between said heel counter and ankle counter on each side of said structural molded inner shell.

6. A footwear as defined in claim 4 further comprising a lining extending along an inside surface of said ankle counter.

7. A footwear as defined in claim 4 wherein said structural molded inner shell further comprises a tendon guard rising above said ankle counter and said lateral and medial quarters.

8. A footwear as defined in claim 7 further comprising a lining extending along an inside surface of said ankle counter and said tendon guard.

9. A footwear as defined in claim 7 wherein said structural molded inner shell is shaped to generally conform to the anatomical contour of a human foot and ankle.

10. A footwear as defined in claim 4 wherein said quarters of said structural molded inner shell further comprises edges which together define the opening of said footwear for insertion and removal of the foot, each edge having an upper segment curving outwardly away from each other.

11. A footwear as defined in claim 1 wherein said structural molded inner shell further comprises thinned wall areas to provide more flexibility in selected portion of said structural molded inner shell.

12. A footwear as defined in claim 11 wherein said structural molded inner shell further comprises a stiffening member.

13. A footwear as defined in claim 12 wherein said stiffening member defines said sole, said ankle counter and a portion of said heel counter which links said ankle counter and said sole together to form a continuous stiffening member.

14. A footwear as defined in claim 13 wherein said stiffening member is chemically bonded to the rest of said structural molded inner shell.

15. A footwear as defined in claim 14 wherein said stiffening member is more rigid than the rest of said structural molded inner shell.

16. A footwear as defined in claim 13 wherein one of said thinned wall areas is located in between said ankle counter and said sole defined by said stiffening member in said lateral and medial quarters.

17. An ice skate comprising:

(a) a structural molded inner shell for supporting and enclosing a foot having a bottom area, a length, right and left sides, a back, and a toe area, said inner shell having an inner side, an outer side, a sole portion covering the bottom area of the foot, lateral and medial quarters extending along the length of the foot and projecting upwardly from each side of said sole portion to cover the right and left sides of the foot, and a heel counter surrounding the back of the foot and linking said lateral and medial quarters together;

(b) an outer skin permanently bonded onto said outer side of said inner shell, said outer skin comprising right and left quarters that only cover said heel counter and said lateral and medial quarters of said inner shell and extend at least partially but not completely under said sole portion of said inner shell;

(c) a frontal toe portion substantially covering the toe area of the foot;

(d) a tongue covering the upper frontal area of said inner shell; and (e) an ice runner holder and ice runner assembly mounted to the bottom of said ice skate.

18. An ice skate as defined in claim 17 further comprising a footbed cushioning the sole portion and a lower inner portion of each side of said structural molded inner shell.

19. An ice skate as defined in claim 17 wherein said ankle counter is shaped to overlie the wearer's malleoli.

20. An ice skate as defined in claim 19 wherein said structural molded inner shell further comprises depression areas located between said heel counter and ankle counter on each side of said structural molded inner shell.

21. An ice skate as defined in claim 18 further comprising a lining extending along an inside surface of said ankle counter.

22. An ice skate as defined in claim 20 wherein said structural molded inner shell is shaped to generally conform to the anatomical contour of a human foot and ankle.

23. An ice skate as defined in claim 22 wherein said quarters of said structural molded inner shell further comprises edges which together define the opening of said footwear for insertion and removal of the foot, each edge having an upper segment curving outwardly away from each other.

24. An ice skate as defined in claim 22 wherein said structural molded inner shell further comprises thinned wall areas to provide more flexibility in selected portion of said structural molded inner shell.

25. An ice skate as defined in claim 24 wherein said structural molded inner shell further comprises a stiffening member.

26. An ice skate as defined in claim 25 wherein said stiffening member defines said sole, said ankle counter and a portion of said heel counter which links said ankle counter and said sole together to form a continuous stiffening member.

27. An ice skate as defined in claim 26 wherein said stiffening member is chemically bonded to the rest of said structural molded inner shell.

28. An ice skate as defined in claim 27 wherein said stiffening member is more rigid than the rest of said structural molded inner shell.

29. An in-line roller skate comprising:

(a) a structural molded inner shell for supporting and enclosing a foot having a bottom area, a length, right and left sides, a back, and a toe area, said inner shell having an inner side, an outer side, a sole portion covering the bottom area of the foot, lateral and medial quarters extending along the length of the foot and projecting upwardly from each side of said sole portion to cover the right and left sides of the foot, and a heel counter surrounding the back of the foot and linking said lateral and medial quarters together;

(b) an outer skin permanently bonded onto said outer side of said inner shell, said outer skin comprising right and left quarters that only cover said heel counter and said lateral and medial quarters of said inner shell and extend at least partially but not completely under said sole portion of said inner shell;

(c) a frontal toe portion substantially covering the toe area of the foot;

(d) a tongue covering the upper frontal area of said inner shell; and (e) an in-line roller chassis mounted to the bottom of said in-line roller skate.

30. An in-line roller skate as defined in claim 29 further comprising a footbed cushioning the sole portion and a lower inner portion of each side of said structural molded inner shell.

31. An in-line roller skate as defined in claim 29 wherein said ankle counter is shaped to overlie the wearer's malleoli.

32. An in-line roller skate as defined in claim 31 wherein said structural molded inner shell further comprises depression areas located between said heel counter and ankle counter on each side of said structural molded inner shell.

33. An in-line roller skate as defined in claim 30 further comprising a lining extending along an inside surface of said ankle counter.

34. An in-line roller skate as defined in claim 33 wherein said structural molded inner shell is shaped to generally conform to the anatomical contour of a human foot and ankle.

35. An in-line roller skate as defined in claim 34 wherein said quarters of said structural molded inner shell further comprises edges which together define the opening of said footwear for insertion and removal of the foot, each edge having an upper segment curving outwardly away from each other.

36. An in-line roller skate as defined in claim 35 wherein said structural molded inner shell further comprises thinned wall areas to provide more flexibility in selected portion of said structural molded inner shell.

37. An in-line roller skate as defined in claim 36 wherein said structural molded inner shell further comprises a stiffening member.

38. An in-line roller skate as defined in claim 37 wherein said stiffening member defines said sole, said ankle counter and a portion of said heel counter which links said ankle counter and said sole together to form a continuous stiffening member.

39. An in-line roller skate as defined in claim 38 wherein said stiffening member is chemically bonded to the rest of said structural molded inner shell.

40. An in-line roller skate as defined in claim 39 wherein said stiffening member is more rigid than the rest of said structural molded inner shell.

* * * * *